United States Patent [19]

Upton

[11] 4,188,998

[45] Feb. 19, 1980

[54] WELL PACKER BYPASS VALVE SEAL ASSEMBLY

[75] Inventor: Thomas E. Upton, Garland, Tex.

[73] Assignee: Dresser Industries, Inc., Dallas, Tex.

[21] Appl. No.: 895,423

[22] Filed: Apr. 12, 1978

[51] Int. Cl.[2] ..... E21B 33/12; B65D 53/02

[52] U.S. Cl. ..... 166/129; 166/183; 277/123

[58] Field of Search ..... 166/128, 129, 152, 131, 166/184, 183, 334; 277/167.3, 178, 207 R, 207 A, 215, 188 R, 188 A, 187, 192–194, 199, 123–125; 137/625.25

[56] References Cited

U.S. PATENT DOCUMENTS

| | | | |
|---|---|---|---|
| 1,776,911 | 9/1930 | Jones | 277/123 |
| 1,780,764 | 11/1930 | Noble | 277/123 |
| 3,148,732 | 9/1964 | Gage | 166/334 |
| 3,163,225 | 12/1964 | Perkins | 166/128 |
| 3,287,022 | 11/1966 | Soechting | 277/188 R |
| 3,419,280 | 12/1968 | Wheeler | 277/124 |
| 3,731,740 | 5/1973 | Douglas | 166/120 |
| 3,735,814 | 5/1973 | Tucker | 166/217 |

*Primary Examiner*—James A. Leppink
*Attorney, Agent, or Firm*—Richard M. Byron

[57] ABSTRACT

A seal assembly for a bypass valve in a well packer has a tubular seal carrier with a pair of annular seal elements mounted in a longitudinally spaced relation about the inner periphery thereof. The annular seal elements are anchored in separate inwardly flared grooves around the interior of the seal carrier in such that they are prevented from being dislodged by fluid pressure. An outer seal element is mounted around the outer periphery of the seal carrier to seal between the seal carrier and a bypass valve housing of the well packer.

6 Claims, 3 Drawing Figures

WELL PACKER BYPASS VALVE SEAL ASSEMBLY

BACKGROUND OF THE INVENTION

The invention is related to a seal assembly for an internal valve of an oil well packer.

Normally, a well packer is used in oil or gas operations to seal one zone above the packer from another zone below the packer within the casing of a wellbore. Packers are used for numerous operations such as zone flow testing, cementing, acidizing, and other fracturing operations.

One of the primary requirements of a satisfactory well packer is that it may be placed at a desired location and selectively set into a gripping and sealing engagement across the well casing so it can support fluid pressure from above or below and effectively isolate two zones within the casing string. When a packer is sealed in a casing one seal is formed between an exterior portion of the packing and an interior portion of the casing and additionally another seal is formed within the packer between a mandrel and a internal valve within the packer. Obviously, the failure of either of the seals can result in fluid leakage between the separated zones within the casing which is basically undesirable. The achievement of a dependable and reliable seal within the packers internal valve has presented a difficultly in the development of well packers.

A typical packer internal valve seal assembly is shown in U.S. Pat. No. 3,735,814, issued May 29, 1973 to Tucker, which discloses a seal carrier that contains a ring of elastomeric material placed within a seal carrier ring and secured in the packer body. This particular seal ring is bonded to and molded in place inside the seal carrier ring and a groove is formed around a midportion of the face seal.

In the normal operation of a packer, fluid flows through a port immediately above the seal assembly, through the valve chamber, past the face of the seal and into the packer body cavity below while the packer is being run into or withdrawn from the well casing. In the setting operation of the packer, the packer body is displaced upward over the mandrel and the valve member on the mandrel engages the face portion of the seal ring. When this occurs, a relatively higher fluid flow rate is experienced by this seal element as the valve member moves toward the seal ring. The high fluid flow rate at this time tends to erode or deteriorate the seal capability of this valve seal rather rapidly. In extreme cases where the fluids contain particulate material and travel at relatively high flow rates, the valve seal can be eroded to the point of leaking after opening and closing the valve only two or three times. Another inherent difficulty with a bonded seal such as shown in this patent is retaining the elastoremic seal in the metal carrier ring. This problem is particularly acute for a seal shown in this patent because the dimension of the seal across the bottom of the groove is significantly larger than the depth dimension of the seal within the groove. Therefore, the broad portion of this seal can easily be pulled from the groove when high flow rates are encountered and if there is a failure in the bond or a failure in the seal material, this will allow a portion or possibly all of the seal to be dislodged from the carrier ring. The gross result of failure of a packer internal valve is that leakage can occur between the zones which are desired to be isolated within the well casing, thereby hindering the operation being performed on a particular well.

Also when these seals are damaged, the packer must be disassembled and the valve seal carrier replaced with another unit which is time consuming, troublesome, and expensive for oil well field operations.

Another patent, U.S. Pat. No. 3,731,740, issued May 8, 1973 to Douglas, shows a hydraulically set well packer which has a valve seal assembly similar to that described in the above-mentioned patent incorporated into the balance valve portion thereof. The service environment of this balance valve is essentially the same as the above described valve and it has essentially the same operating difficulties.

SUMMARY OF THE INVENTION

A packer valve seal assembly is provided which has a tubular seal carrier that is mountable within the valve housing of a well packer. The seal carrier assembly is constructed with a pair of annular seal elements mounted in longitudinally spaced relation around the inner periphery of the seal carrier. The seal elements are mounted in separate grooves which have a generally cross-sectionally dovetail or an internally flared configuration which anchors the seal elements in the grooves to prevent undue flexing of the seal elements and provides resistance to seal degradation. The seal carrier assembly has an outer seal mounted around the outer perimeter thereof to seal between the carrier assembly and the associated packer housing.

One object of this invention is to provide a well packer valve seal assembly which overcomes the aforementioned disadvantages of the prior art devices.

Still, one other object of this invention is to provide a well packer valve seal assembly having a pair of seal elements mounted in a tubular seal carrier which are anchored sufficiently to prevent the seals from being deteriorated by high flow rates as the packer valve is opened and closed.

Still, one other object of this invention is to provide a packer seal assembly which has dual seals either of which is capable of sealing the packer valve and either of which can be easily replaced in the field by the simple removal of a retainer ring and replacement of the seal element.

Various other objects, advantages, and features of this invention will become apparent to those skilled in the art from the following discussion, taken in conjunction with the accompanying drawings, in which:

Figure 1:
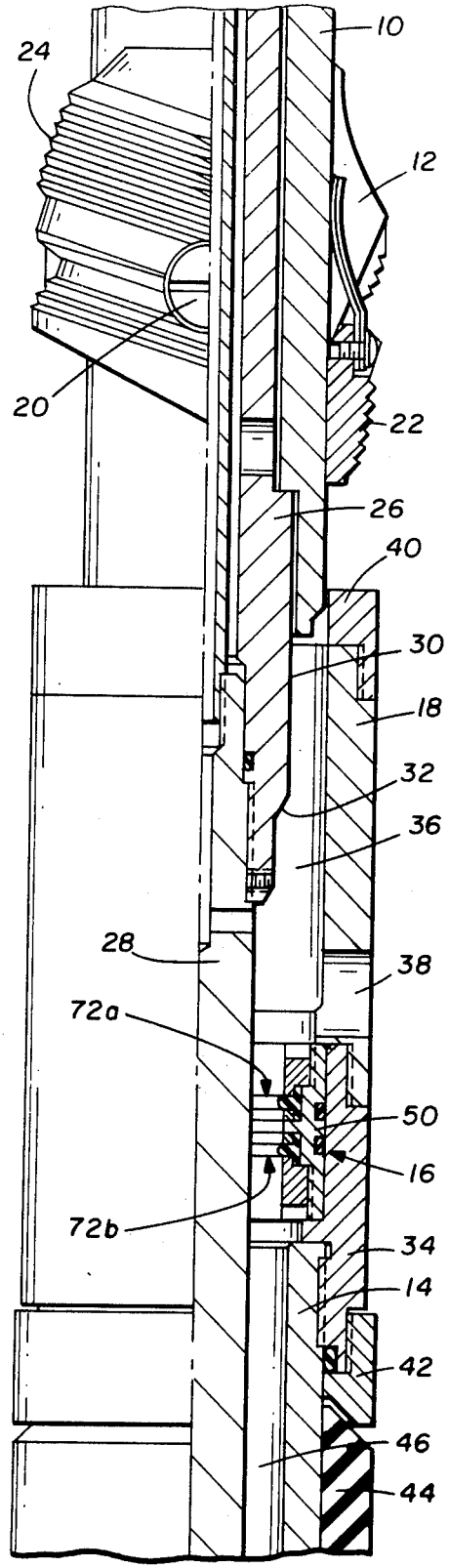
FIG. 1 is a partially cutaway elevation view of a central portion of a well packer which incorporates the valve seal assembly of this invention.

The following is a discussion and description of the preferred specific embodiments of the well packer valve seal assembly of this invention, such being made with reference to the drawings, whereupon the same reference numerals are used to indicate the same or similar parts and/or structure. It is to be understood that such discussion and description is not to unduly limit the scope of the invention.

DETAILED DESCRIPTION OF THE INVENTION

FIG. 1 shows a portion of a mechanically actuated packer which has the bypass valve thereof fitted with the valve seal assembly of this invention. The portion of the packer shown, includes a slip carrier 10 with a slip 12 mounted thereon, a mandrel extending through the length of the packer, a packer body 14, the novel valve seal assembly of this invention indicated generally at 16, and a housing 18. Slip 12 is pivotally mounted on slip carrier 10 by pivot pins 20 extending from opposite sides of the slip carrier 10 and mounted through openings in opposite sides of the slip. Slip 12 is provided with two gripping surfaces 22 and 24 on opposite sides thereof to engage the interior of the well casing. The mandrel runs the length of the packer interior and is constructed in a mandrel upper section 26 and a mandrel lower section 28 which are threadedly joined for convenience in construction. Mandrel upper section 26 is provided with a smooth cylindrically shaped surface 30 on the lower portion thereof which joins a radially inwardly inclined surface 32 to form the valve member for the packer internal valve.

Valve seal assembly 16 is mounted within the interior of a collar 34, collar 34 is threadedly attached to the upper end of packer body 14. Housing 18 is threadedly joined to collar 34 and extends upward to enclose the valve member on mandrel upper section 26 and define a valve chamber 36. A port 38 is provided through the housing 18 immediately above collar 34. A cap 40 is threadedly mounted on the upper end of the housing 18.

Below valve assembly 16 the packer body 14 supports an adapter ring 42 and a plurality of expandable rubbers and spacers for sealing between the exterior of packer body 14 and the interior of the well casing when the packer is set. A portion of one of the rubbers is shown and indicated at 44. A packer body cavity 46 is formed within packer body 14 and it is in fluid communication with the valve chamber through the interior of the valve seal assembly.

Figure 3:
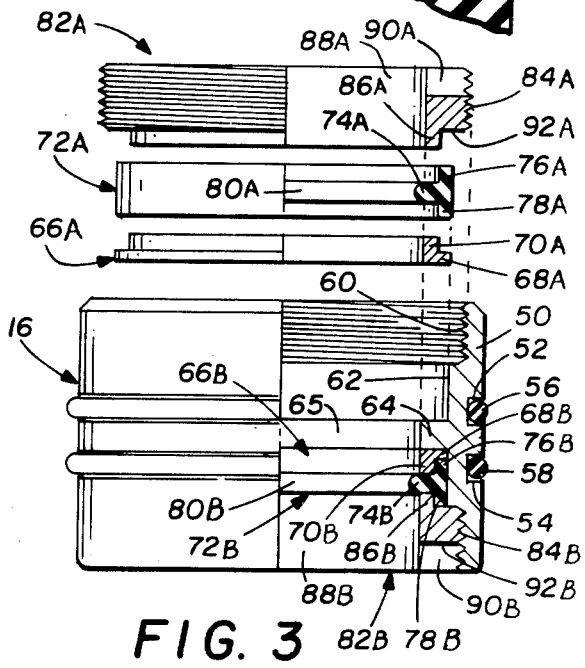
FIG. 3 is an enlarged partially cutaway elevation view of the seal carrier assembly with the seal spacer ring, seal ring, and seal retainer ring on one end and displaced in an exploded relation.

Referring to FIG. 3, the valve seal assembly includes a tubular seal carrier 50 which has a pair of annular seal elements mounted in grooves around the interior thereof in a longitudinally spaced relation. Seal carrier 50 is a tubular member with a stepped recess formed in each end for mounting a seal spacer ring, the seal element and a seal retainer ring. Because both the upper and lower portions of the tubular valve seal carrier are identical, only one portion will be described in detail.

In regard to seal carrier 50, the exterior thereof is substantially cylindrically shaped with the exception of a pair of spaced apart grooves 52 and 54 around the outer periphery thereof to receive and mount O-rings 56 and 58 respectively for sealing around the outer periphery of the seal carrier within its mounting collar 34 in the packer. The interior of each end of seal carrier 50 is provided with a stepped recess including an outer larger diameter threaded portion 60 and an inner smaller diameter on shallower smooth surface portion 62. Smooth surface stepped portion 62 extends from approximately the mid-portion of the stepped recess to an inwardly extending ridge 64 around a mid-portion of the seal carrier. Ridge 64 forms an abutment or separation between the smooth surface stepped portions on both sides of seal carrier 50 and functions as the separation between the two seal elements. Ridge 64 terminates inside seal carrier 50 at a uniform diameter inner peripheral surface 65.

The two seal elements, spacer rings and retainer rings are identical and will be referred to hereinafter by a common numeral followed by the numeral A or B for the separate associated portions of the structure.

Spacer ring 66A is a generally L-shaped member including a radially disposed portion 68A and a longitudinally disposed portion or lip 70A. When mounted spacer ring 66A rests with radially disposed portion 68A abutting seal carrier ridge 64 and the interior surface of the longitudinally disposed portion or lip 70A substantially aligned with seal carrier ridge inner surface 65. The seal element is indicated generally at 72A in the exploded portion of FIG. 3 and it is a generally cross-sectionally T-shaped ring of elastomeric material. Seal element 72A includes a radially disposed portion 74A around the interior thereof which intersects and joins a longitudinally disposed outer portion 76A. When seal element 72 is mounted with seal carrier 50, the seal's outer peripheral surface 78A rests in sealing contact with the surface of the smooth stepped portion 62. Also the seal inner peripheral surface 80A around the inner perimeter of radially disposed portion 74A extends into the interior of seal carrier 50 beyond ridge inner peripheral surface 65.

Seal retainer ring 82A has a threaded exterior 84A to threadedly engage seal carrier threaded step portion 60. The inner side of retainer ring 82 is provided with a lip 86A extending longitudinally relative to the seal carrier around the inner peripheral portion thereof which will overlie one edge of seal element longitudinally disposed portion 76A when the unit is assembled. Seal retainer ring interior surface 88A is arranged to substantially align with the interior surface of the spacer ring and seal carrier ridge inner peripheral surface 65. A pair of notches 90A are provided on opposite sides of what is the outer end portion of seal retainer ring 82A so that a suitable tool can be engaged with a retainer ring for assembly and disassembly of the seal assembly. Retainer ring 82 is tightened with inner surface 92 resting on the radially disposed abutment between threaded step 60 and smooth step 62.

When the valve seal assembly is completed, both seal rings are mounted in seal carrier 50 like seal ring 72B in lower portion of FIG. 3. In this configuration seal inner peripheral surface 80B extends inwardly slightly beyond the interior surfaces of the spacer rings, the retainer rings and ridge inner peripheral surface 65. This seal spacing is necessary so the inner periphery of the seal elements will contact the valve member when the packer valve is closed.

Figure 2:
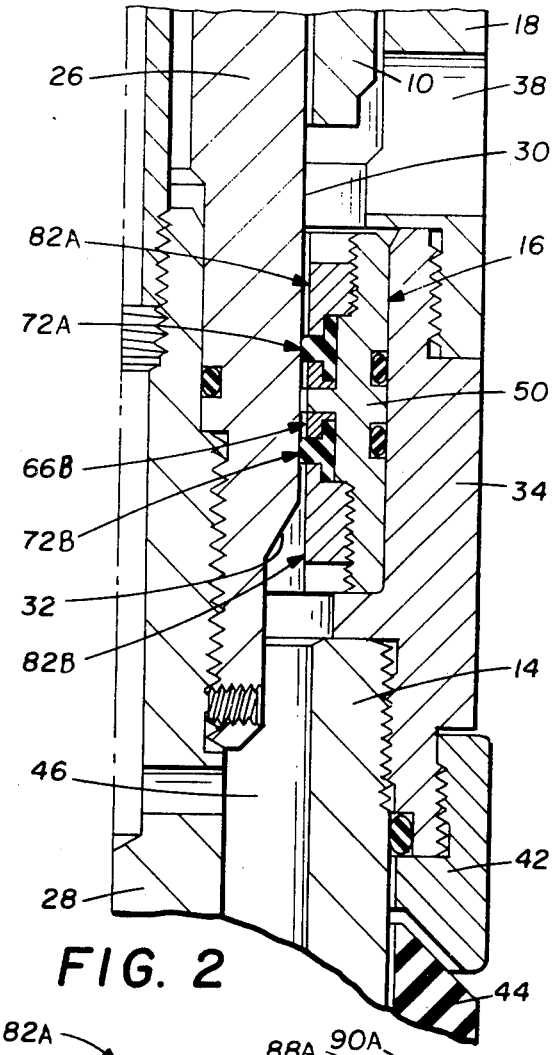
FIG. 2 is an enlarged partially cutaway elevation view of the valve seal assembly and associated portions of the packer shown in FIG. 1 with the valve in a closed position.

FIG. 2 shows the valve seal assembly with the packer valve in a closed or entered position. At this time, the inner peripheral surfaces of both of the seal elements are in fluid tight sealing engagement with the packer valve member 30. It is to be noted that both of the seal elements are resting on the cylindrically shaped surface portion of packer valve member 30. When the packer valve is opened or closed, fluid passes through the opening of seal carrier 50 at a relatively high velocity which will tend to blow out or displace the valve seal elements from their mountings. The unique construction of this valve seal assembly prevents the seal elements from being blown out because of the cross-sectionally T-shaped seal elements which are secured or anchored by lips on the spacer and retainer rings. Because the seal elements are accessible by removing the threadedly mounted seal retainer, they can be easily and relatively rapidly replaced by a technician in the field in the event one should deteriorate to the point of leaking.

In use of this novel valve seal assembly, it has been found that the seal elements can be easily replaced under field conditions in the event they deteriorate and begin to leak. Also in the use of this seal assembly, it has been found that by using the pair of closely retained seal elements, the above-mentioned problems with blown out seals has been virtually eliminated without compromising the ability of the packer valve to seal. Additionally, it has been found that in the event one of the seal elements leaks, the remaining seal elements are sufficient to prevent fluid leakage of the packer valve regardless of whether the higher pressure is above or below the packer.

The embodiments of the invention in which an exclusive property or privilege is claimed are defined as follows:

1. In a well packer having a mandrel mountable with a tubular support for the packer; a slip mounted on a tubular slip carrier around the mandrel; a tubular packer body mounted around and operably connected to said mandrel; a tubular bypass valve housing mounted with the packer body having a bypass valve seat assembly therein; and a tubular bypass valve member on the outer periphery of said mandrel engageable with said bypass valve seat assembly when said well packer is in a set condition; an improved bypass valve seat assembly comprising:

a tubular seal carrier mounted within an end portion of said bypass valve housing;

a pair of independent annular seal elements mounted in a longitudinally spaced relation around the inner periphery of said seal carrier, said seal elements being anchored in opposite end portions of said seal carrier in separate grooves each of which are formed by a radially outer groove portion having a greater longitudinal dimension, relative to the longitudinal axis of the tubular seal carrier, than a connecting radially inner groove portion which opens toward the bypass valve member, and said seal elements being shaped in conformance with their associated groove;

said seal carrier has an annular seal retainer secured thereto and mounted in each end thereof to retain the respective seal element in the associated groove; and said seal carrier having an outer seal element mounted around the outer periphery thereof to seal between said seal carrier and said bypass valve housing.

2. The improved bypass valve seat assembly of claim 1, wherein:

said tubular seal carrier has a stepped recess within the interior of each end portion thereof, each of said stepped recesses extends inwardly from the associated end of said tubular seal carrier to a transversely inwardly extending ridge around a midportion of the tubular seal carrier;

said stepped recesses each include a large diameter threaded portion extending from the associated end of said tubular seal carrier to a mid-portion of the recess, and a shallower non-threaded portion extending from said large diameter threaded portion to said ridge;

a seal spacer ring mounted in each of said recess shallow portion adjacent to said ridge; and a seal retainer ring threadedly mounted in each recess large diameter threaded portion in opposed relation to the associated spacer ring such that facing portions of said spacer rings and said seal retainer rings in cooperation with said recess shallow portions form said grooves in order to anchor said seal rings in the associated grooves.

3. A seal assembly for a valve in a well packer, comprising:

a tubular seal carrier assembly mountable within a recess in an interior portion of a valve housing, said seal carrier assembly having a pair of annular seal elements mounted in a longitudinally spaced relation around the inner periphery thereof;

a pair of grooves formed around the inner periphery of said seal carrier with said seal elements mounted therein, said grooves are each formed by an internal recess within and around the interior of each end portion of said tubular seal carrier;

a spacer ring is mounted in said recess;

a seal retainer ring is threadedly mounted in the end portion of said recess;

said seal elements are each cross-sectionally generally T-shaped with one portion thereof extending inward to sealingly engage a valve element, and the other portion thereof located in the radially outer portion of said groove and adjacent to an interior surface portion of the associated seal carrier recess and said seal elements each positioned between the associated seal retainer ring and said spacer ring; and an outer seal having an annular seal element mounted in a groove around the outer perimeter of said seal carrier assembly for sealing between said seal carrier and said valve body housing.

4. The seal assembly of claim 3, wherein:

said spacer ring has a lip extending from around an inner peripheral portion thereof toward said seal retainer ring and over a portion of said seal ring; and said seal retainer ring has a lip extending from and around an inner peripheral portion thereof toward said spacer ring and extending over a portion of said seal ring.

5. A downhole well tool valve seal assembly comprising:

a tubular seal carrier mountable within a tool body between a valve chamber and a tool body cavity;

an outer peripheral seal mounted in a groove around the exterior of said tubular seal carrier for sealing between the outer perimeter of said tubular seal carrier and an inner surface of a recess portion of said packer body which mounts said valve seal assembly;

a stepped recess within the interior of each end portion of said tubular seal carrier extending inward from the opposed ends thereof to a transversely inwardly extending lip around a mid-portion, said stepped recesses each having a large diameter threaded portion extending from said opposed ends to a mid-portion of the recess and a shallow portion extending from said large diameter portion to said lip;

a seal spacer ring mounted in each recess shallow portion adjacent to said lip;